US005127060A

United States Patent [19]

Paddock

[11] Patent Number: 5,127,060

[45] Date of Patent: Jun. 30, 1992

[54] CENTERING DEVICE FOR SPEAKER DIAPHRAGM

[75] Inventor: Paul W. Paddock, McMinnville, Oreg.

[73] Assignee: Linaeum Corporation, Portland, Oreg.

[21] Appl. No.: 499,492

[22] PCT Filed: Oct. 2, 1987

[86] PCT No.: PCT/US87/02559

§ 371 Date: Mar. 29, 1990

§ 102(e) Date: Mar. 29, 1990

[87] PCT Pub. No.: WO89/03160

PCT Pub. Date: Apr. 6, 1989

[51] Int. Cl.[5] ..... H04R 25/00

[52] U.S. Cl. ..... 381/197; 381/192; 381/194; 381/202; 381/204

[58] Field of Search ..... 181/171, 172; 381/89, 381/117, 150, 158, 182, 192, 194, 195, 197, 202, 204

[56] References Cited

U.S. PATENT DOCUMENTS

| | | | |
|---|---|---|---|
| 3,477,540 | 11/1969 | Rizo-Patron | 381/158 |
| 3,686,446 | 8/1972 | Manger | 381/117 |
| 4,464,785 | 8/1984 | Kagdis | 381/117 |
| 4,584,439 | 4/1986 | Paddock | 381/89 |
| 4,665,550 | 5/1987 | Haas | 381/182 |
| 4,903,308 | 2/1990 | Paddock et al. | 381/202 |

FOREIGN PATENT DOCUMENTS

| | | | |
|---|---|---|---|
| 1123506 | 5/1982 | Canada | 381/197 |
| 2709972 | 9/1978 | Fed. Rep. of Germany | 381/204 |
| 2712451 | 9/1978 | Fed. Rep. of Germany | 381/204 |
| 8903160 | 4/1989 | PCT Int'l Appl. | 381/197 |

*Primary Examiner*—James L. Dwyer
*Assistant Examiner*—William Cumming
*Attorney, Agent, or Firm*—Klarquist, Sparkman, Campbell, Leigh & Whinston

[57] ABSTRACT

An audio transducer includes a diaphragm having webs extending, along a central expanse between opposed magnets. Flexible centering tubes extend through the expanse and are secured to a clamp which is adjustably fixed to the transducer frame. Each of the flexible centering tubes provides passive lateral centering of expanse above a predetermined frequency and actively restrains movement of the expanse in the plane thereof when the transducer is operated at or below the predetermined frequency.

21 Claims, 4 Drawing Sheets

CENTERING DEVICE FOR SPEAKER DIAPHRAGM

TECHNICAL FIELD

This invention relates to audio transducers.

BACKGROUND ART

Audio transducers, specifically loud speakers and microphones, have been disclosed in a variety of forms. One such audio transducer is disclosed in my previously issued U.S. Pat. No. 4,584,439, Audio Transducer With Controlled Flexibility Diaphragm. That patent discloses the provision of string-like supports which are secured to the diaphragm and extend to the transducer framework. Nylon string was used as the preferred material to support the center expanse of the diaphragm in the transducer of the patent.

Although nylon string performed adequately for its intended purpose, the use of a non-resilient, string-like material did not allow completely free movement of the diaphragm at high frequencies and prevented adequate diaphragm movement at lower frequencies.

Further, the construction of the transducer described in the patent did not provide for an adjustable mechanism which would facilitate adjustment of the central expanse of the diaphragm relative to the magnets surrounding the central expanse. In some instances, the central expanse of the diaphragm would come in contact with the magnets of the transducer, thereby creating an undesirable buzzing sound. This situation prevented manufacture of a transducer having a narrow gap between a magnetic field generator.

An object of the instant invention is to provide an improved centering device for an audio transducer.

Another object of the instant invention is to provide an adjustable diaphragm centering device for an audio transducer.

A further object of the instant invention is to provide a centering device which is passive or acoustically transparent, over a first selected portion of the transducer's operating range while being active, i.e., restricting movement of the transducer diaphragm, over a second selective portion of the transducer's operating range.

Another object of the instant invention is to provide an improved centering device in a frame which facilitates adjustable placement of the centering device.

Still another object of the instant invention is to provide a centering device having elastic, resilient characteristics.

A further object of the invention is to provide grommet means which serve as a form for a coil in the transducer.

Yet another object of the instant invention is to provide a centering device for a transducer which damps out non-linear characteristics of a diaphragm of the transducer.

DISCLOSURE OF THE INVENTION

The improved centering device of the instant invention is intended for use in an audio transducer having a diaphragm which includes a pair of elongate, resilient webs, having intermediate portions disposed with one beside the other and joined to each other to form a moveable expanse in the diaphragm. The expanse extends substantially in a plane and is moveable in the direction of the plane The webs of the diaphragm have flexible curved end portions which extend from the expanse and are secured to a transducer frame An electric coil is attached to the expanse of the diaphragm. Opposed magnets are provided for producing opposing magnetic fields which extend normal to the expanse. The transducer is connected to an audio amplifier.

The transducer frame includes a top and a base A spacer extends between the top and base and includes a center portion which has a pair of opposed magnet-receiving chambers. Spacer panels are provided which radiate outwardly from the center portion, extending between the top and the base, in a substantially X-shaped array. The center portion has a gap between the chambers for receiving the diaphragm expanse.

A grommet extends through the diaphragm expanse normal to the plane thereof and fixes a resilient, elongate cylindrical member to the diaphragm. A clamp is adjustably secured to the frame and holds the centering member and the expanse in a desired position.

These and other objects and advantages of the invention will be more fully apparent as the description which follows is read in conjunction with the drawings.

BEST MODE OF CARRYING OUT THE INVENTION

Figure 1:
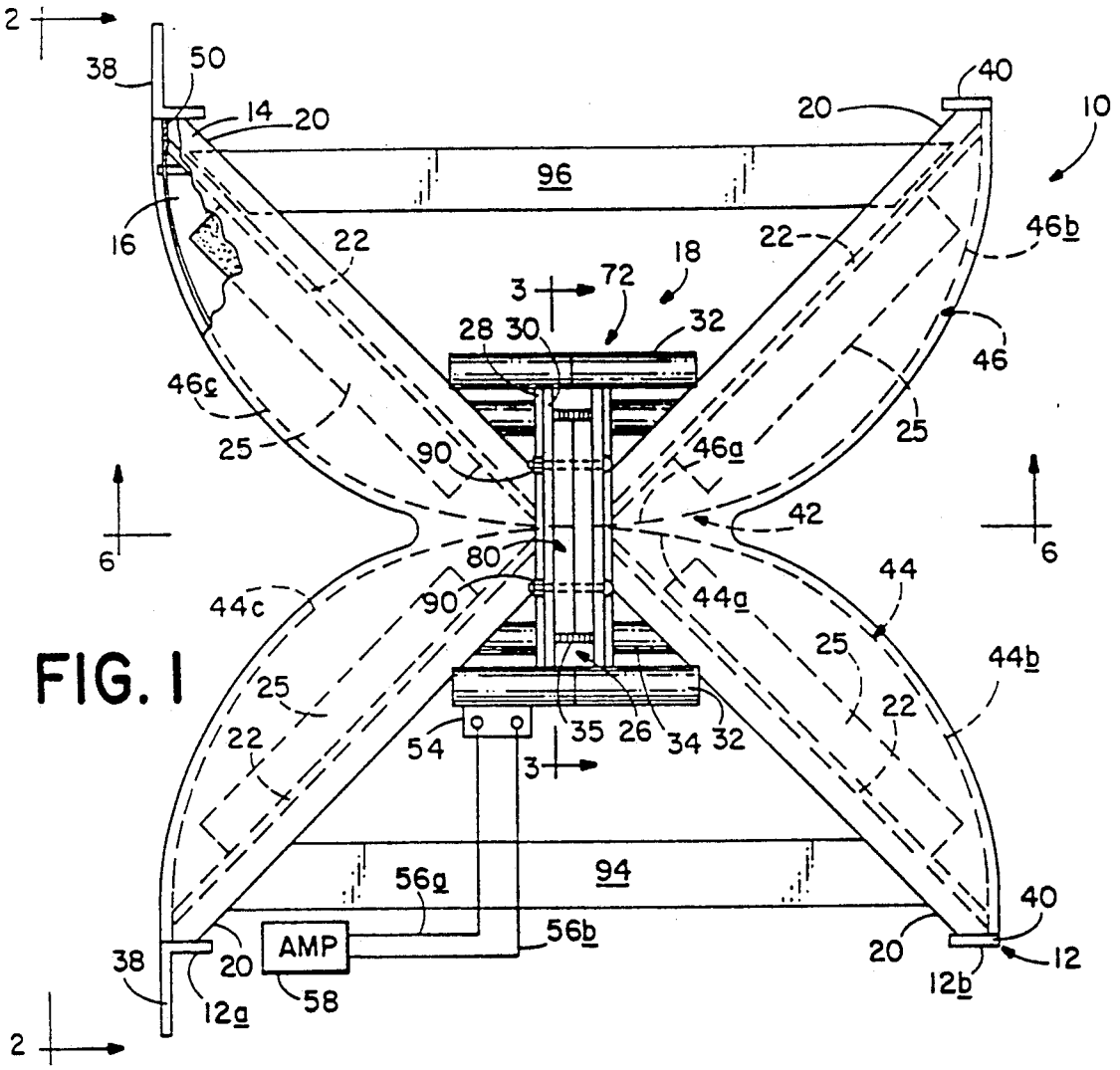
FIG. 1 is a top plan view of an audio transducer having an improved centering device, constructed according to the invention.
Figure 2:
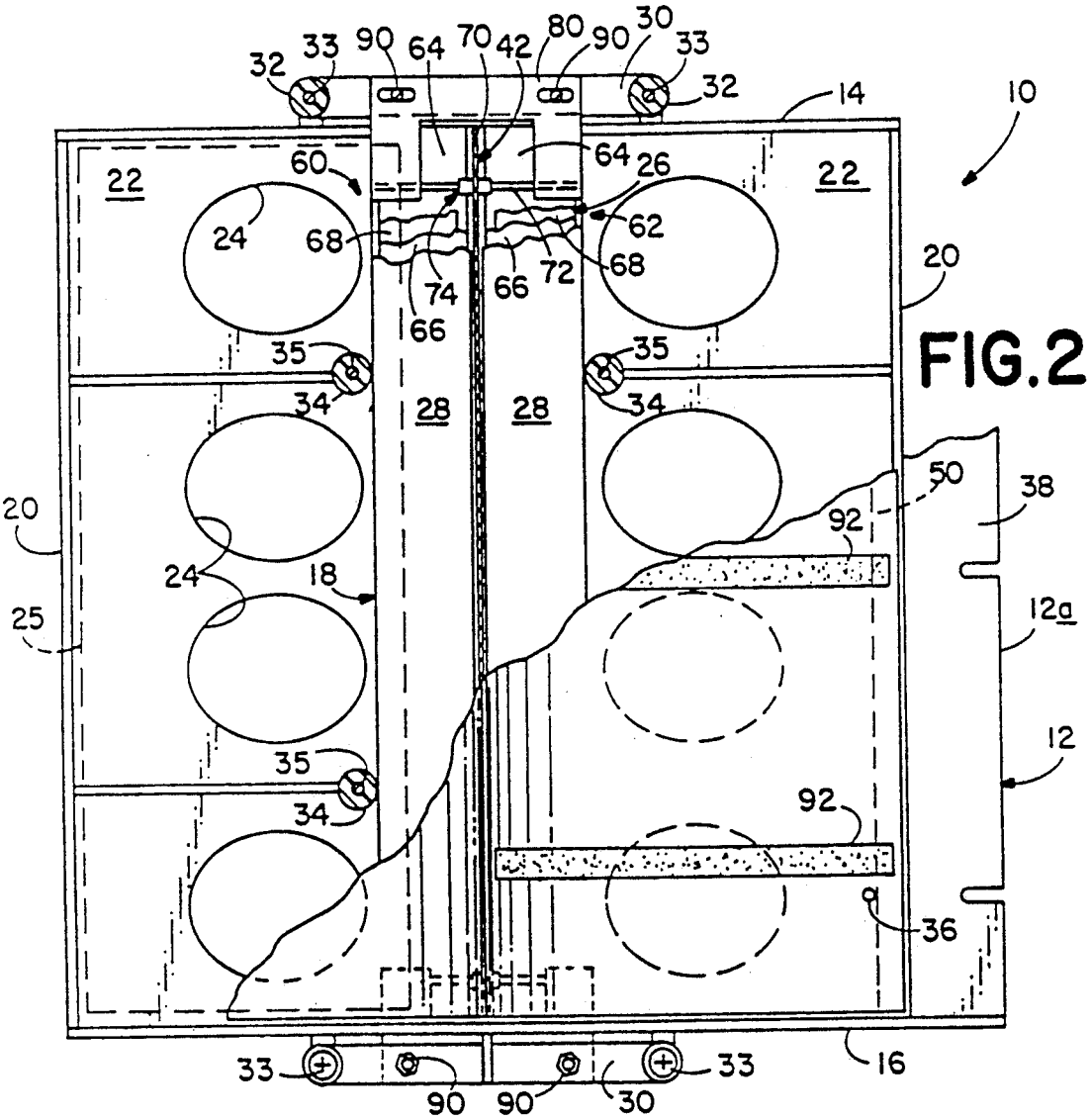
FIG. 2 is a front view of the transducer taken generally along the line 2—2 of FIG. 1, with portions broken away to show detail.

Turning now to the drawings, and initially to FIGS. 1 and 2, an audio transducer constructed according to the invention is shown generally at 10. Transducer 10 includes a frame, shown generally at 12, which is specially designed to accommodate the centering device of the invention. Frame 12 has a top 14 and a base 16. A spacer, or center portion, 18 maintains the top and base in a spaced apart relationship.

In the preferred embodiment, one-half of the top, base and spacer is formed, as by molding, into, virtually identical halves **12*a* and 12*b***. The two halves are then joined together to form the frame.

The frame, when viewed from the top as in FIG. 1, has a shape which is suggestive of a butterfly, having four wing-like elements, such as elements 20 A spacer panel 22 extends from center portion 18 along element 20 in a substantially X-shaped array. In the preferred embodiment, each panel has bores, or wasted areas 24 formed therein to provide vents in the frame. The vents are operable to prevent compression of the back wave generated by the transducer. Damping pads 25 are fixed to panels 22 to attenuate the back wave and prevent bounce of the back wave generated by the transducer. Pads 25 are formed from a suitably dense material which is not acoustically transparent. Holes are formed in pads 25 which are aligned with wasted areas 24.

Figure 3:
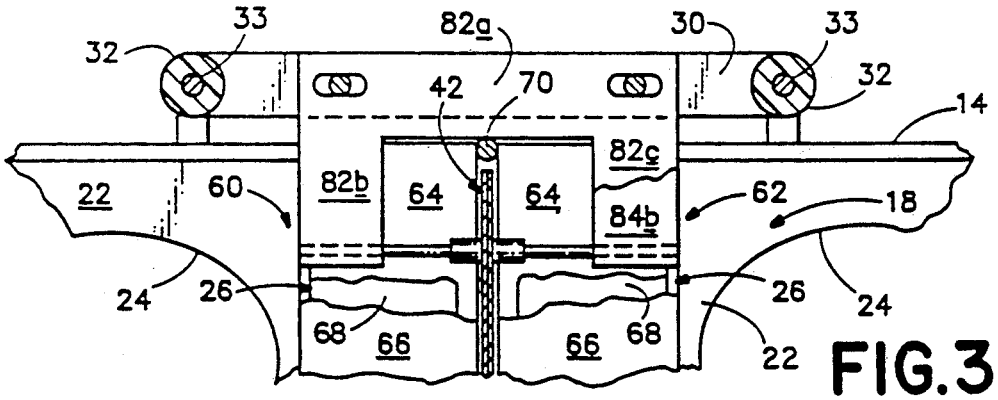
FIG. 3 is an enlarged view of the centering device, taken generally along the line 3—3 of FIG. 1.

Referring now to FIGS. 1, 2 and 3, center portion 18 includes a chamber 26 which is enclosed on two sides thereof by center portion walls 28, two of which are formed on frame half 12*a* and the other two of which are formed on frame half 12*b*.

Frame 12 also includes tabs 30 which extend outward from top 14 and base 16 A boss 32 is located at either end of tab 30 and has a bore therethrough A fastener, such as a screw 33, is received in the bores of opposing bosses 32 for holding the two halves of the frame together Additional bosses 34 are formed on spacer panels 22 and are constructed similarly to bosses 32, but have a space between opposed bosses when the frame is assembled Bosses 34 are secured to one another by screws 35.

Frame 12 also includes pins 36 (see FIGS. 1 and 6) at the free ends of spacer panels 22. Mounting flanges 38 are formed on frame half 12*b* while mounting elements 40 are formed on frame half 12*a*. The flanges and mounting elements are used to fasten the transducer to a speaker housing, which will be described later herein Frame 12, in the preferred embodiment, is injection molded and is formed of ABS plastic.

Returning again to FIGS. 1, 2 and 3, as described in my previously issued U.S Pat. No. 4,584,439, a diaphragm 42, as used in transducer 10, includes a pair of elongate resilient webs 44, 46 The webs have a rectangular, curved form and extend between the top and bottom of the frame. Each web has an intermediate portion 44*a*, 46*a*, which are joined together to form an expanse 48. Extending from the intermediate portions are flexible, curved end portions 44*b*, 44*c* and 46*b*, 46*c*. The end portions are secured at locations remote from expanse 48 and, in the preferred embodiment, are secured to the free ends of spacer panels 22. Specifically, each end portion has holes punched therein which fit over pins 36, also referred to herein as diaphragm fixing means. A length of double sided tape 50 is adhesively fixed to the end portions and to spacer panel 22.

In the preferred embodiment, webs 44, 46 are formed of polyester film This material, when used at a thickness of 127 mm (0.005 inches) has been found to more readily deform to an acoustic signal and exhibits very few material-related resonance effects.

Referring now to FIGS. 1, 4, 5 and 6, a coil, or coil means 51 is sandwiched between webs 44 and 46 in expanse 48. Coil 51 is formed of thin wire and is formed on a backing 52, which in the preferred embodiment is a paper substrate having an adhesive layer thereon for holding the wires of the coil. Coil leads (not shown) extend from coil 51 to a terminal 54. An additional set of leads 56*a*, 56*b*, extend from terminal 54 to amplifier 58, which drives the transducer. The coil leads, terminal 54 and leads 56*a*, 56*b* comprise what is referred to herein as connectors or connector means.

Returning to FIGS. 2 and 3, opposing magnetic field means 60, 62 are received in chambers 26 on either side of expanse 48. Magnetic field means as used in transducer 10 include a pair of spaced apart plates 64, 66 having magnets 68 sandwiched therebetween The opposing field means 60, 62 generate a magnetic field which is substantially perpendicular to expanse 48. A gap is maintained between field means 60 and field means 62 by a spacer 70 which is a non-magnetic material, and which, in the preferred embodiment, is a length of copper wire having a diameter of approximately 1.27 mm (0.050 inches). Spacer 70 provides a gap between the field means which allow passage of expanse 48 of diaphragm 42 therethrough. In the preferred embodiment, spacer 70 is received in opposed bores on frame halves 12*a*, 12*b*. Field means 60, 62 are held in chamber 26 by means of screws which are secured in opposed bosses 34. The field means are then additionally fixed in place by Si-rubber sealant Thus the magnetic field means are held securely in the frame of the transducer about a gap having a predetermined and precisely fixed size.

Figure 4:
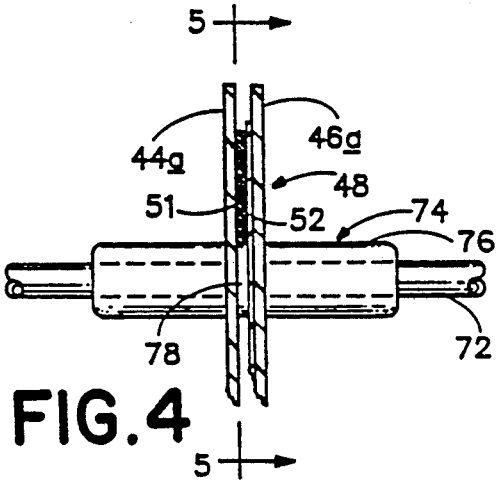
FIG. 4 is a greatly enlarged side plan view of grommet means of the invention.
Figure 5:
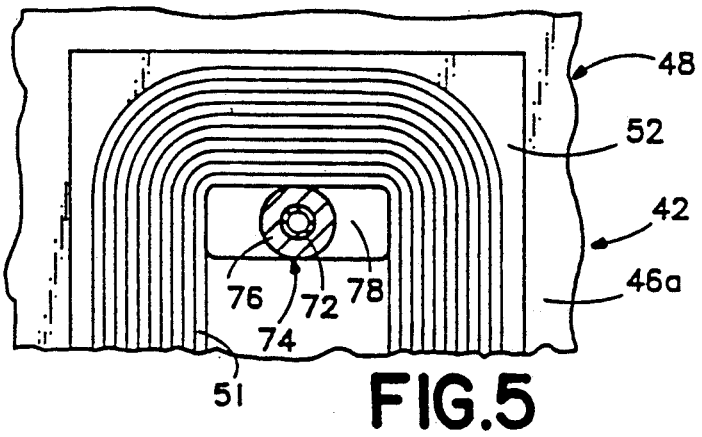
FIG. 5 is a greatly enlarged front plan view of grommet means of the invention, taken generally along the line 5—5 of FIG. 4.

Referring now to FIGS. 3, 4 and 5, additional components of the centering device of the invention will be described. Centering means 72 are provided to position expanse 48 equadistant between field means 60 and 62. In the preferred embodiment centering means take the form of a resilient, elongate cylindrical member which is formed of silicon rubber tubing.

Means for securing centering means 72 to the expanse are provided in the form of a grommet, or grommet means 74. In the preferred embodiment, grommet means include an elongate hollow tube 76 which has a flange 78 fixed intermediate the ends thereof. The flange is arranged to be perpendicular to the longitudinal axis of tube 76. Flange 78 is secured between the webs of the diaphragm forming expanse 48. The flange has a thickness in the preferred embodiment of about 0.191 mm (0.0075 inch) which is substantially equal to that of coil 51. In the preferred embodiment, grommet 74 is formed of injection molded nylon.

Centering means 72 is disposed through the interior of tube 76 and the two elements are constructed and arranged such that once centering means 72 is passed through tube 76, it will remain therein without shifting along the length of the tube.

Diaphragm 42 is assembled by first forming coil 51. Backing 52 is positioned on a coil winder. Backing 52 has a pair of holes formed in either end thereof which are sized to receive tube 76 therein. Coil 51 is then wound on backing 52 utilizing flange 78 as a form, or coil form means to provide shaping for the ends of coil 51. In the preferred embodiment, coil 51 is formed of ten turns of silver wire, having a diameter of approximately 0.14 mm (U.S. gauge 36). Silver wire has been found to be a preferable material for the coil of the speaker as it has approximately two times the heat dissipating ability of copper wire. Once the coil is formed, the wire is fixed to backing 52 by spraying with a contact cement material. One of the diaphragm webs is laid flat on a work surface and the preformed coil and backing is affixed to the expanse portion of the web. Grommets 74 are positioned through holes in the web to position the coil on the diaphragm with flange 78 facing upwards. The second web is then positioned over the grommets and the coil and is fixed in place, generally by adhesive. Thus, the expanse 48 is formed having coil means 51 and flanges 78 sandwiched between webs 44 and 46.

Figure 6:
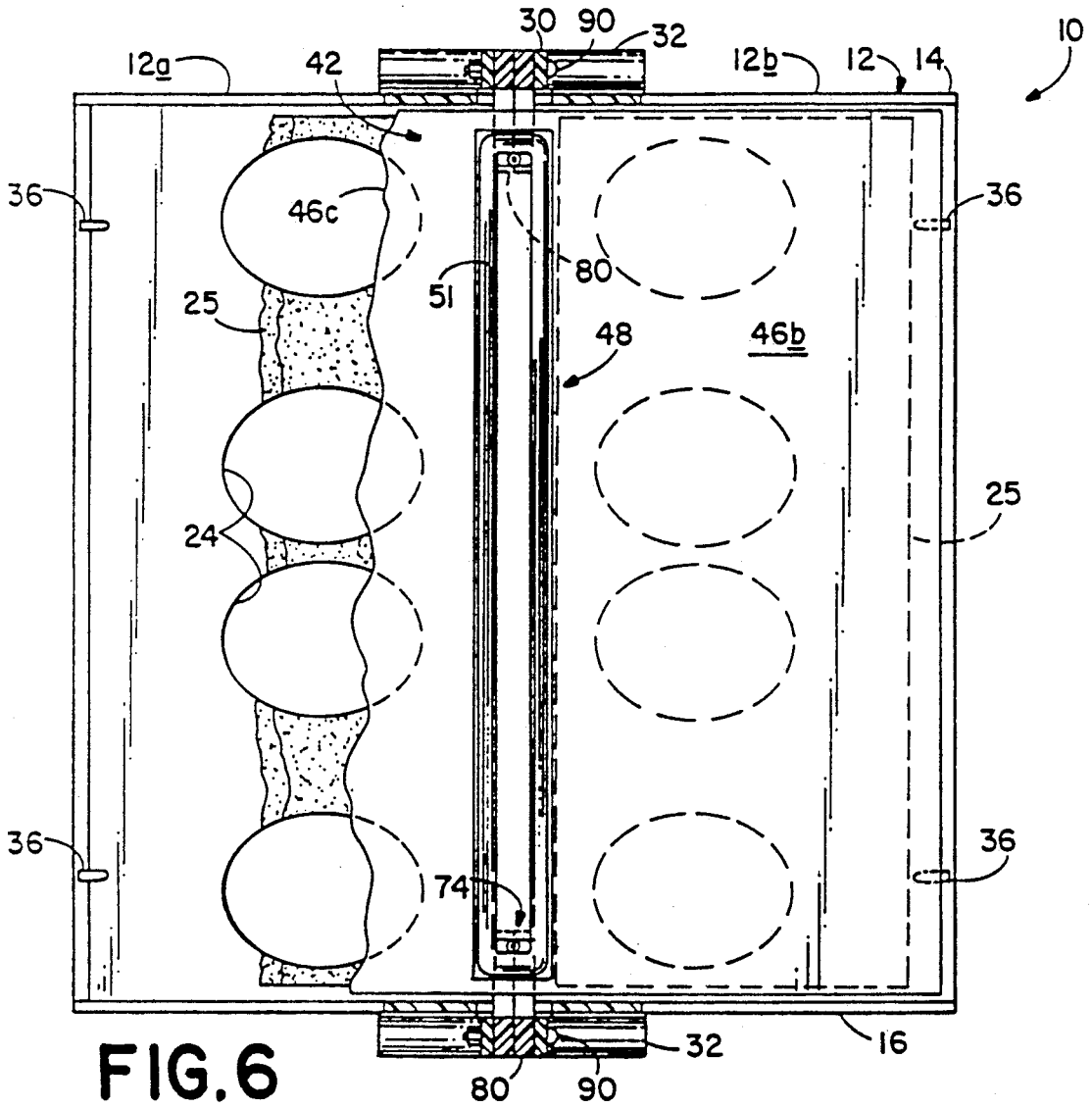
FIG. 6 is a median sectional view of the transducer, taken generally along the line 6—6 of FIG. 1.

Referring now to FIGS. 2, 3 and 6, centering means 72 is held, at either end thereof, by a clamp or clamp means 80. Clamp 80 is essentially a U-shaped structure made up of clamp elements 82, 84 Elements 82, 84 are mirror images of one another and include a cross piece 82*a*, 84*a* and arms 82*b*, 84*b* and 82*c*, 84*c*, respectively. Elements 82, 84 are formed, as by injecting molding, with complimentary structures to be snapped together Each clamp 80 is adjustably secured to tabs 30, also referred to herein as clamp fastening means, at the top and base of frame 12.

A substantially triangular shaped wasted area is formed toward the free end of each arm and, when the elements are secured together, form a receptacle for the free ends of centering means 72, which will be slightly deformed and snugly retained in the receptacle Once centering means 72 is positioned in the clamp, the clamp is glued together.

Clamp 80 is fixed to tab 30 by means of nut and bolt combinations 90. The clamp is adjustable perpendicular to the plane of expanse 48 by means of the slots formed in cross pieces 82*a*, 84*a* through which bolts 90 extend. The arms of clamp 80 extend through ports, formed between frame halves 12*a*, 12*b*, into chamber 26.

The material used to form centering means 72 is selected such that it will maintain the lateral position of expanse 48 between opposing magnetic field means 60, 62 through all operating frequencies of transducer 10 Centering means 72 is, however, operable to allow free motion of the expanse in the plane thereof when the transducer is operated above a predetermined frequency, generally 800 Hz, and is further operable to restrain free movement of the expanse in the plane thereof when the transducer is operated at or below the predetermined frequency. This result is achieved because the expanse will have greater motion in the plane thereof at lower frequencies than will occur at high frequencies. Centering means 72 has sufficient resiliency to maintain the expanse in a centered position while not impeding motion in the plane thereof at the higher frequencies, when the expanse has less of an excursion in its plane As the operating frequency drops, the expanse is driven through a greater excursion and is somewhat restrained by centering member 72.

The provision of an adjustable clamp, such as clamp 80, provides that should it be necessary to adjust the lateral position of expanse 48 once transducer 10 has been placed in operation, the adjustment may be made without special tools and with a minimum amount of time and effort.

Centering means as has been described herein allow for a much smaller gap between field means 60, 62. As previously noted, the gap between the field means is on the order of 1.27 mm. The smaller gap provides for a more intense magnetic field which results in a transducer having greater efficiency.

In addition to the low frequency damping provided by centering means 72, damping means 92 are provided and are secured to the curved end portion of webs 44, 46. In the preferred embodiment, damping means 92 includes plural damping strips having resonance characteristics different from those of the web material, such as open cell foam. The damping strips are attached to webs 44, 46 by adhesive and will deform with the webs when the webs are moved under the influence of the coil means and amplifier.

Damping means 92 is operable to eliminate harmonic resonance, particularly at the first, second and third partials. In the preferred embodiment, damping means 92 takes the form of strips of medium density polyurethane or polyvinyl, which has been found to damp out non-linear characteristics of the transducer.

Once the frame, field means and diaphragm have been assembled, side stiffeners 94, 96 are installed between the top and bottom of the frame. Stiffeners 94, 96 are formed from a rigid, non-resonant material, such as particle board or structural high density foam Additionally, a medium density damping material, such as polyester fluff, may be inserted between the side stiffeners and spacer panels 22, to further enhance the acoustic properties of the transducer.

Figure 7:
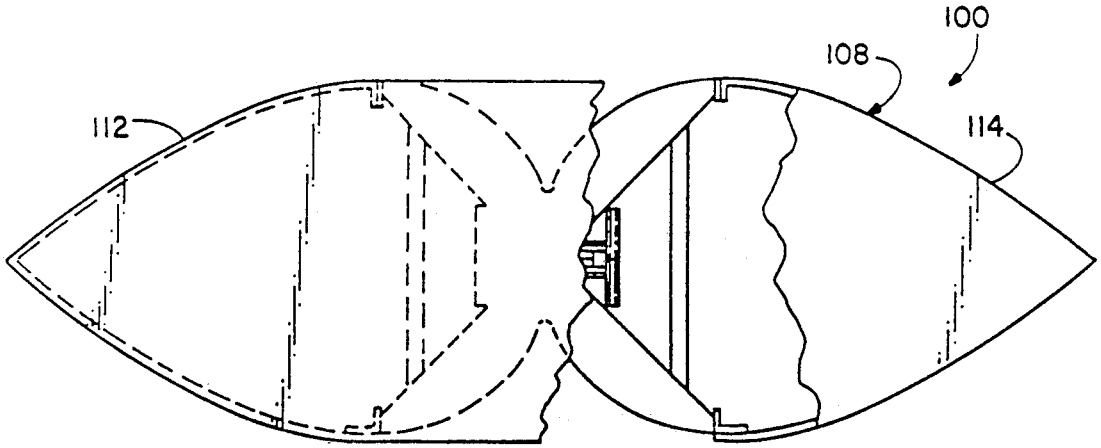
FIG. 7 is a top plan view of a housing containing multiple transducers.
Figure 8:
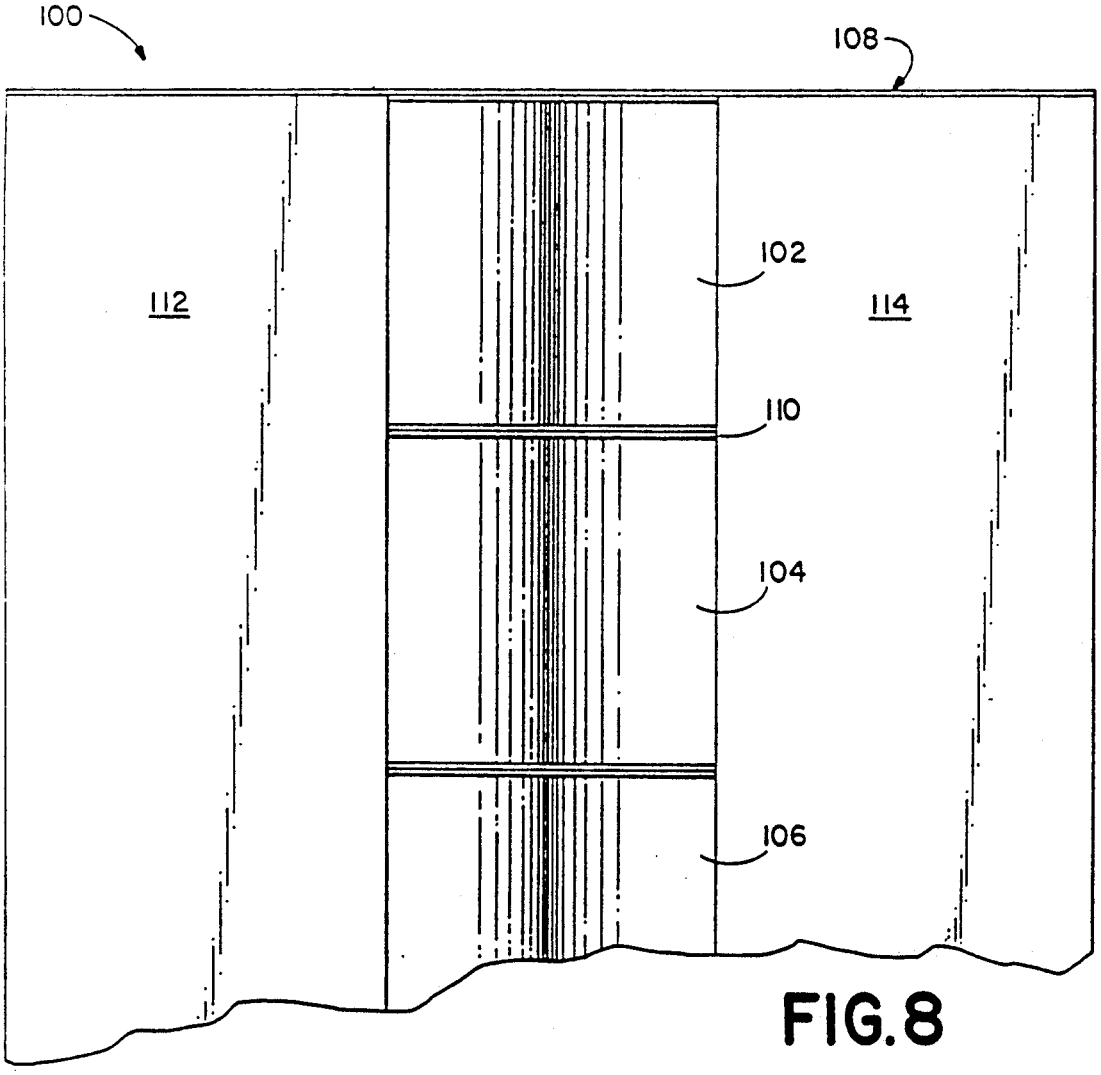
FIG. 8 is a front view of the housing of FIG. 6.

Referring now to FIG. 7 and 8, an array 100 of transducers 102, 104 and 106 is depicted in a speaker housing 108. Housing 108 includes connectors 110 which are used to hold individual transducers together. A pair of wing-like appendages 112, 114 extend from either side of the transducers. In the preferred embodiment, the housing has a width of approximately 30 inches and a height of five feet. The wings are provided to prevent cancellation of by-directionally radiated sound waves which are generated by the array of transducers. If a transducer were placed adjacent a wall and operated without the presence of the wings, it is possible that, at certain frequencies, the reflected sound waves from the rear of the transducer would cancel those generated by the front of the transducer. The wings provide sufficient diffusion to prevent such cancellation. Systems may be constructed utilizing any number of transducers.

A suitable cross over device (not shown) would be connected between the transducers in the housing and the amplifier.

INDUSTRIAL APPLICATION

The transducer of the invention and the improved centering device therefore are particularly adapted for use as loud speakers. Additionally, the transducer of the invention is also suitable for use as a microphone.

I claim:

1. In an audio transducer having a diaphragm including a pair of elongate resilient webs having intermediate portions disposed with one beside the other and joined to each other to form a movable expanse in the diaphragm, the expanse extending substantially in a plane and being movable along an axis perpendicular to the plane, the webs in the diaphragm having flexible curved end portions extending from the expanse which are secured at locations remote from the expanse; coil means attached to the expanse of diaphragm; opposing magnetic field means for producing opposing magnetic fields extending normal to the expanse; and an audio amplifier and means connecting the coil means to the amplifier for conducting electric impulses between the coil means and the amplifier; an improved centering device comprising: a frame having the end portions of the diaphragm secured thereto; grommet means secured to and extending through the diaphragm expanse normal to the plane thereof; centering means fixed to said grommet means; and clamp means adjustably secured to said frame for holding said centering means in a desired position.

2. The centering device of claim 1 wherein said grommet means includes an elongate hollow tube having a flange intermediate the ends thereof.

3. The centering device of claim 2 wherein said flange has a thickness substantially identical to that of the coil means and is sandwiched between the webs with the tube extending to either side thereof to maintain said grommet means normal to the plane of the expanse.

4. The centering device of claim 3 wherein said flange is constructed and arranged to serve as a coil-means form and wherein the coil means extends over said flange.

5. The centering device of claim 2 wherein said centering means includes a resilient, elongate cylindrical member sized snugly to fit within said hollow tube thereby to maintain the position of the expanse relative to the field means.

6. The centering device for claim 5 wherein said centering means is constructed and arranged to maintain the lateral position of the expanse between the opposing field means through all operating frequencies, is operable to allow free motion of the expanse in the plane thereof when the transducer is operated above a predetermined frequency and is further operable to restrain free movement of the expanse in the plane thereof when the transducer is operated at or below the predetermined frequency.

7. The centering device of claim 1 wherein said frame includes a top and a base having a spacer extending therebetween, said spacer including a center portion extending between said top and said base having a pair of opposed magnetic field means-receiving chambers located therein, and spacer panels radiating outwardly from said center portion, extending between said top and said base, in a substantially X-shaped array, each of said panels having diaphragm fixing means on an edge thereof for securing the end portion of the diaphragm to the spacer, said center portion having a gap between said chambers for receiving the diaphragm expanse therein.

8. The centering device of claim 1 which further includes damping means secured to the curved end portions of the webs, said damping means being constructed and arranged to prevent harmonic resonance.

9. The centering device of claim 8 wherein said damping means includes plural damping strips having resonance characteristics different from those of the web material.

10. In an audio transducer having a diaphragm including a pair of elongate resilient webs having intermediate portions disposed with one beside the other and joined to each other to form a movable expanse in the diaphragm, the expanse extending substantially in a plane and being movable along an axis perpendicular to the plane with the webs in the diaphragm having flexible curved end portions extending from the expanse which are secured at locations remote from the expanse; elongate coil means attached to the expanse of diaphragm; opposing magnetic field means for producing opposing magnetic fields extending normal to the expanse; and an audio amplifier and means connecting the coil means to the amplifier for conducting electric impulses between the coil means and the amplifier; an improved centering device comprising: a frame having the end portions of the diaphragm secured thereto; grommet means including an elongate hollow tube having a flange intermediate the ends thereof, said flange having a thickness substantially identical to that of the coil, said flange being sandwiched between the webs in the expanse for maintaining said grommet means normal to the plane of the expanse; a resilient, elongate cylindrical member sized snugly to fit within said tube; and a substantially U-shaped clamp having member retaining means adjacent the ends thereof for securely grasping said member therein, said clamp being positioned on said frame to maintain the expanse between and equadistant from the opposed magnetic field means.

11. The centering device of claim 10 wherein said cylindrical member is operable to allow free motion of the expanse in the plane thereof when the transducer is operate above a predetermined frequency and is further operable to retard free movement of the expanse at or below the predetermined frequency.

12. The centering device of claim 10 wherein said grommet means includes coil form means thereon and wherein the coil means extends over said coil form means.

13. The centering device of claim 9 wherein said frame includes clamp fastening means for providing adjustable fastening of said clamp means to said frame.

14. The centering device of claim 13 wherein said clam includes a pair of clamp elements, said elements being mirror images of one another, and wherein said retaining means includes a wasted area formed in each arm of said clamp, one-half of the wasted area being formed in each element, for receiving and deforming a portion of said member therein.

15. The centering device of claim 10 which further includes damping means secured to the curved end portions of the webs, said damping means being constructed and arranged to prevent harmonic resonance.

16. The centering device of claim 15 wherein said damping means includes plural damping strips having resonance characteristics different from those of the web material.

17. The centering device of claim 10 wherein said frame includes a top and a base having a spacer extending therebetween, said spacer including a center portion extending between said top and said base having a pair of opposed magnetic-field-means-receiving chambers located therein, and spacer panels radiating outwardly from said center portion, extending between said top and said base, in a substantially X-shaped array, each of said panels having diaphragm fixing means on an edge thereof for securing the end portion of the diaphragm to the spacer, said center portion having a gap between said chambers for receiving the diaphragm expanse therein.

18. In an audio transducer having a diaphragm including a pair of elongate resilient webs having intermediate portions disposed with one beside the other and joined to each other which form a movable expanse in the diaphragm, the expanse extending substantially in a plane and being movable along an axis perpendicular to the plane with the webs in the diaphragm having flexible curved end portions extending from the expanse which are secured at locations remote from the expanse; elongate coil means attached to and extending along the expanse of diaphragm; opposing magnetic field means for producing opposing magnetic fields extending normal to the expanse; and an audio amplifier and means connecting the coil means to the amplifier for conducting electric impulses between the coil means and the amplifier; an improved centering device comprising: a frame having the end portions of the diaphragm secured thereto; said frame including a top and a base having a spacer extending therebetween, said spacer including a center portion extending between said top and said base having a pair of opposed magnetic-field-means-receiving chambers located therein, and spacer panels radiating outwardly from said center portion, extending between said top and said base, in a substantially X-shaped array, each of said panels having diaphragm-fixing means on an edge thereof for securing the end portion of the diaphragm to the spacer, said center portion having a gap between said chambers for receiving the diaphragm expanse therein; a resilient, elongate centering member which extends through the expanse and is secured to the frame and is operable to maintain the expanse between and equidistant between the opposed magnetic field means, and is further operable to allow free motion of the expanse in the plane thereof when the transducer is operated above a predetermined frequency and is also operable to retard free movement of the expanse at or below the predetermined frequency; and means for securing said centering member to the expanse to prevent movement of said centering member relative to the expanse.

19. The centering device of claim 18 wherein said means for securing said centering member include an elongate hollow tube having a flange intermediate the ends thereof, said flange having a thickness substantially identical to that of the coil means, said flange being sandwiched between the webs in the expanse for maintaining said hollow tube normal to the plane of the expanse and for providing a form for the coil means.

20. The centering device of claim 19 which further includes a substantially U-shaped claim having a centering member retaining means adjacent the ends thereof for securely grasping the ends of said centering member therein, said clamp being positioned on said frame to maintain the expanse between and equidistant from the opposed magnetic field means.

21. The centering device of claim 20 wherein said frame includes clamp fastening means for providing adjustable fastening of said clamp means to said frame, said clamp fastening means including tabs located on said top and said base adjacent to said magnetic field means-receiving chambers for securing said clamp thereto, said top and said base having ports therein for receiving the ends of said clamp therein.

* * * * *

UNITED STATES PATENT AND TRADEMARK OFFICE

CERTIFICATE OF CORRECTION

PATENT NO. : 5,127,060

DATED : June 30, 1992

INVENTOR(S) : Paul W. Paddock

It is certified that error appears in the above-indentified patent and that said Letters Patent is hereby corrected as shown below:

Column 1, line 68, "plane The" should read --plane. The--.

Column 2, line 2, "frame An" should read --frame. An--.

Column 2, line 8, "base A" should read --base. A--.

Column 2, line 61, "20 A" should read --20. A--.

Column 3, line 11, "16 A" should read --16. A--.

Column 3, line 12, "therethrough A" should read --therethrough. A--.

Column 3, line 14, "together Additional" should read --together. Additional--.

Column 3, line 18, "assembled Bosses" should read --assembled. Bosses--.

Column 3, lines 25-26, "herein Frame" should read --herein. Frame--.

Column 3, line 31, "46 The" should read --46. The--.

UNITED STATES PATENT AND TRADEMARK OFFICE

CERTIFICATE OF CORRECTION

PATENT NO. : 5,127,060

DATED : June 30, 1992

INVENTOR(S) : Paul W. Paddock

It is certified that error appears in the above-indentified patent and that said Letters Patent is hereby corrected as shown below:

Column 3, line 45, "film This" should read --film. This--.

Column 3, line 64, "therebetween The" should read --therebetween. The--.

Column 5, line 8, "receptacle One" should read --receptacle. One--.

Column 5, line 20, "10 Centering" should read --10. Centering--.

Column 5, line 34, "plane As" should read --plane. As--.

Column 6, lines 1-2, "foam Additionally" should read --foam. Additionally--.

Signed and Sealed this

Twenty-third Day of November, 1993

*Attest:*

*Attesting Officer*

Bruce Lehman

BRUCE LEHMAN

*Commissioner of Patents and Trademarks*